US006147665A

United States Patent [19]

Friedman

[11] Patent Number: 6,147,665

[45] Date of Patent: Nov. 14, 2000

[54] COLUMN DRIVER OUTPUT AMPLIFIER WITH LOW QUIESCENT POWER CONSUMPTION FOR FIELD EMISSION DISPLAY DEVICES

[75] Inventor: Jay Friedman, Felton, Calif.

[73] Assignee: Candescent Technologies Corporation, San Jose, Calif.

[21] Appl. No.: 09/162,823

[22] Filed: Sep. 29, 1998

[51] Int. Cl.[7] ..... G09G 3/22

[52] U.S. Cl. ..... 345/75.2; 345/204; 315/169.3

[58] Field of Search ..... 345/75.2, 74.1, 345/204, 211; 315/169.1, 169.3; 313/422

[56] References Cited

U.S. PATENT DOCUMENTS

| | | | |
|---|---|---|---|
| 4,431,949 | 2/1984 | Wahlquist et al. | 315/368.26 |
| 5,162,789 | 11/1992 | Moriya et al. | 340/814 |
| 5,469,026 | 11/1995 | Madsen | 315/169.4 |
| 5,477,105 | 12/1995 | Curtin et al. | 313/422 |
| 5,541,473 | 7/1996 | Duboc, Jr. et al. | 313/422 |
| 5,559,389 | 9/1996 | Spindt et al. | 313/310 |
| 5,564,959 | 10/1996 | Spindt et al. | 445/24 |
| 5,578,899 | 11/1996 | Haven et al. | 313/422 |
| 5,607,335 | 3/1997 | Spindt et al. | 445/50 |
| 5,608,283 | 3/1997 | Twichell et al. | 313/309 |
| 5,847,515 | 12/1998 | Lee | 315/169.1 |
| 5,867,136 | 2/1999 | Zimlich | 345/74 |
| 5,898,415 | 4/1999 | Hansen et al. | 345/74 |
| 6,040,809 | 3/2000 | Friedman | 345/74 |
| 6,067,061 | 5/2000 | Friedman | 345/74 |

OTHER PUBLICATIONS

Sendra and Smith. *Microelectronic Circuits*. Oxford University Press, 4th edition, 1997. pp. 839–848.

*Primary Examiner*—Bipin Shalwala
*Assistant Examiner*—Ricardo Osorio
*Attorney, Agent, or Firm*—Wagner, Murabito & Hao LLP

[57] ABSTRACT

The present invention provides for an amplifier circuit for use within a column driver of a field emission display (FED) device. In one embodiment of the present invention, the amplifier circuit has a high slew rate and a low quiescent current, and includes: an input for receiving an input voltage signal, an output for providing an output voltage signal, a voltage sensing circuit for monitoring a voltage differential between the input voltage signal and the output voltage signal, and a current-boosting circuit responsive to the voltage differential for providing additional bias current to the voltage sensing circuit to increase the slew rate of the output voltage signal. Significantly, the current-boosting circuit is inactive when the input voltage signal and the output voltage signal are substantially equivalent. In this way, bias current and power dissipation are maintained at a low level during quiescent conditions. In furtherance of the present embodiment, the input of the amplifier circuit is configured for coupling to D/A conversion circuits of the column driver to receive the input voltage signal, and the output of the amplifier circuit is configured for coupling to a column line of the FED to drive the output voltage over the column line.

21 Claims, 6 Drawing Sheets

COLUMN DRIVER OUTPUT AMPLIFIER WITH LOW QUIESCENT POWER CONSUMPTION FOR FIELD EMISSION DISPLAY DEVICES

FIELD OF THE INVENTION

The present invention pertains to the field of flat panel display screens. More specifically, the present invention relates to the field of flat panel field emission display devices (FEDs).

BACKGROUND OF THE INVENTION

Flat panel field emission displays (FEDs), like standard cathode ray tube (CRT) displays, generate light by impinging high energy electrons on a picture element (pixel) of a phosphor screen. The excited phosphor then converts the electron energy into visible light. However, unlike conventional CRT displays which use a single electron beams, or in some cases three electron beams, to scan across the phosphor screen in a raster pattern, FEDs use stationary electron beams for each color element of each pixel. This allows the distance from the electron source to the display screen to be very small compared to the distance required for the scanning electron beams of the conventional CRTs. Furthermore, FEDs consume far less power than CRTs. These factors make FEDs ideal for portable electronic products such as laptop computers, pocket-TVs, personal digital assistants and portable electronic games.

As mentioned, FEDs and conventional CRT displays differ in the way the image is scanned. Conventional CRT displays generate images by scanning an electron beam across the phosphor screen in a raster pattern. During the raster scan, a electron beam scans along the row (horizontal) direction, and its intensity is adjusted according to the desired brightness of each pixel of the row. After a row of pixel is scanned, the electron beam steps down a row and scans the next row with its intensity modulated according to the desired brightness of that row. In marked contrast, FEDs generate images according to a "matrix" addressing scheme that does not involve scanning a single beam across the screen. Each electron beam of the FED is formed at the intersection of individual rows and columns of the display. Rows are updated sequentially. A single row electrode is activated alone with all the columns active, and the voltage applied to each column determines the strength of the electron beam formed at the intersection of that row and column. Then, the next row is subsequently activated and new brightness information is set again on each of the columns. When all the rows have been updated, a new frame is displayed.

Brightness of the pixels depends on the voltage potential applied across the row electrode and the gate electrode. The larger the voltage potential, the brighter the pixel. In addition, brightness of the pixel depends on the amount of time the voltage potential is applied. The larger the amount of time that a potential difference is applied, the brighter the pixel. In operation, all columns are driven with gray-scale data and simultaneously one row is activated. The gray-scale information causes the column drivers to assert different voltage amplitudes (amplitude modulation) to realize the different gray-scale contents of the pixel. This causes a row of pixels to illuminate with the proper gray scale data. This is then repeated for another row, etc., until the frame is filled.

FIG. 1A is a block diagram 5 illustrating a conventional operational amplifier ("op-amp") 10 that may be used to drive the columns of an FED device with different voltage amplitudes. As illustrated, op-amp 10 is configured as a voltage follower. More specifically, op-amp 10 is configured to receive an input voltage V, from D/A converters (not shown) and to provide the necessary current to drive the columns of the FED to the same voltage. One problem associated with the conventional op-amp 10 is that there is a limited rate of signal change possible at the output of the op-amp 10. The maximum signal change rate is also known as the slew-rate (SR). If the input voltage $V_i$ applied to the op-amp 10 is such that it demands an output response that is faster than the specified value of SR, the op-amp 10 will not comply. As illustrated, in response to a step function input 6*a*, the output of the op-amp 10 will not be able to rise instantaneously; rather, the output 6*b* will be the linear ramp of slope equal to SR.

The slew rate SR is proportional to a bias current, or quiescent current, of an op-amp. FIG. 1B is a common implementation of the op-amp 10 of FIG. 1A. As illustrated in FIG. 1B, op-amp 10 includes a current mirror (transistors Q5 and Q8) for providing a bias current I, which is set by reference current $I_{REF}$ to differential transistor pair Q1 and Q2. For the op-amp 10 illustrated in FIG. 1B, the slew rate would be given by the formula:

$$SR=I/C_c$$

where $C_c$ is the capacitance of the output stage of the op-amp 10. A detailed derivation of the above formula can be found in a reference by Sedra and Smith, entitled Microelectronic Circuits, 4th Edition, Oxford University Press, pp. 839–847.

One way of increasing the slew rate of the op-amp 10 is to increase the reference current $I_{REF}$. Although this conventional method is simple and easy to implement, increasing the reference current $I_{REF}$ would significantly increase quiescent power consumption of the op-amp 10. In other words, in quiescent conditions (e.g. when voltages at the positive input and the negative input are the same) the op-amp 10 would consume a significant amount of power. This is disadvantageous because energy conservation is economically advantageous and also, in FEDs and other portable electronic products, power consumption is a key factor in determining the commercial viability of such products because they are largely battery powered.

Therefore, what is needed is an amplifier having a high slew rate and low quiescent power dissipation. What is further needed is an FED column driver amplifier having a high slew rate and a low quiescent current.

SUMMARY OF THE DISCLOSURE

Accordingly, the present invention provides for an amplifier circuit having a high slew rate and a low quiescent current. In one embodiment of the present invention, the amplifier includes a voltage sensing circuit for monitoring a voltage differential between an input and an output of the amplifier circuit, and a current-boosting circuit responsive to the voltage differential for providing additional bias current to the sensing circuit. As a result, the slew rate of the amplifier circuit of the present invention is increased. Significantly, the current-boosting circuit is inactive when the input voltage and the output voltage are substantially equivalent. In this way, bias current and power dissipation are maintained at a low level during quiescent conditions.

According to one embodiment of the present invention, the current-boosting circuit is configured to be activated by both positive and negative voltage differentials. In this embodiment, the current-boosting circuit comprises two sub-circuits: a first sub-circuit for providing additional bias current to the sensing circuit responsive to a positive voltage differential; and a second sub-circuit for providing additional bias current to the sensing circuit responsive to a negative voltage differential.

In one embodiment of the present invention, the amplifier further comprises a bias current limiter for limiting a maximum amount of additional bias current available to the voltage sensing circuit. In another embodiment of the present invention, the bias current limiter is omitted such that a maximum amount of bias current is available to drive the output at an even higher slew rate.

In yet another embodiment of the present invention, the circuit for sensing a voltage differential between the input and output of the amplifier comprises a differential pair. In one embodiment, the quiescent bias current is provided by a current mirror circuit and is proportional to a quiescent-setting current.

Embodiments of the present invention include the above and further include an FED column driver amplifier comprising: an input and an output, a sensing circuit for monitoring a voltage differential between the input and the output, a current source for providing a quiescent bias current to the sensing circuit, and a current-boosting circuit responsive to the voltage differential for providing additional bias current to the sensing circuit, wherein the current-boosting circuit is inactive when voltages at the input and the output are the same.

BRIEF DESCRIPTION OF THE DRAWINGS

The accompanying drawings, which are incorporated in and form a part of this specification, illustrate embodiments of the present invention and, together with the description, serve to explain the principles of the invention.

DETAILED DESCRIPTION OF THE PREFERRED EMBODIMENTS

Reference will now be made in detail to the present embodiments of the invention, examples of which are illustrated in the accompanying drawings. While the invention will be described in conjunction with the present embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following description, for purposes of explanation, numerous specific details are set forth in order to provide a thorough understanding of the present invention. It will be apparent, however, to one skilled in the art, upon reading this disclosure, that the present invention may be practiced without these specific details. In other instances, well-known structures and devices are not described in detail in order to avoid obscuring aspects of the present invention.

GENERAL DESCRIPTION OF A FIELD EMISSION DISPLAY DEVICE

Figure 1A:
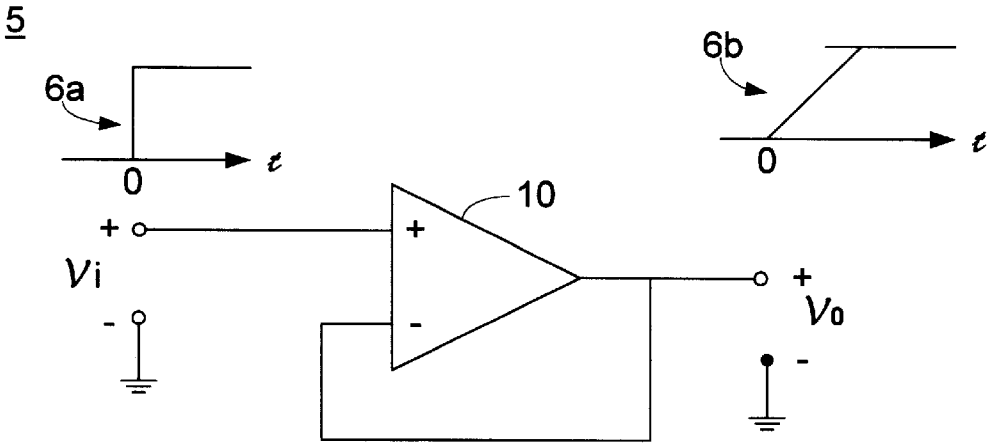
FIGURE 1A (Prior Art)
FIG. 1A is a block diagram illustrating a prior art operational amplifier for driving the column lines of FED devices.
Figure 1B:
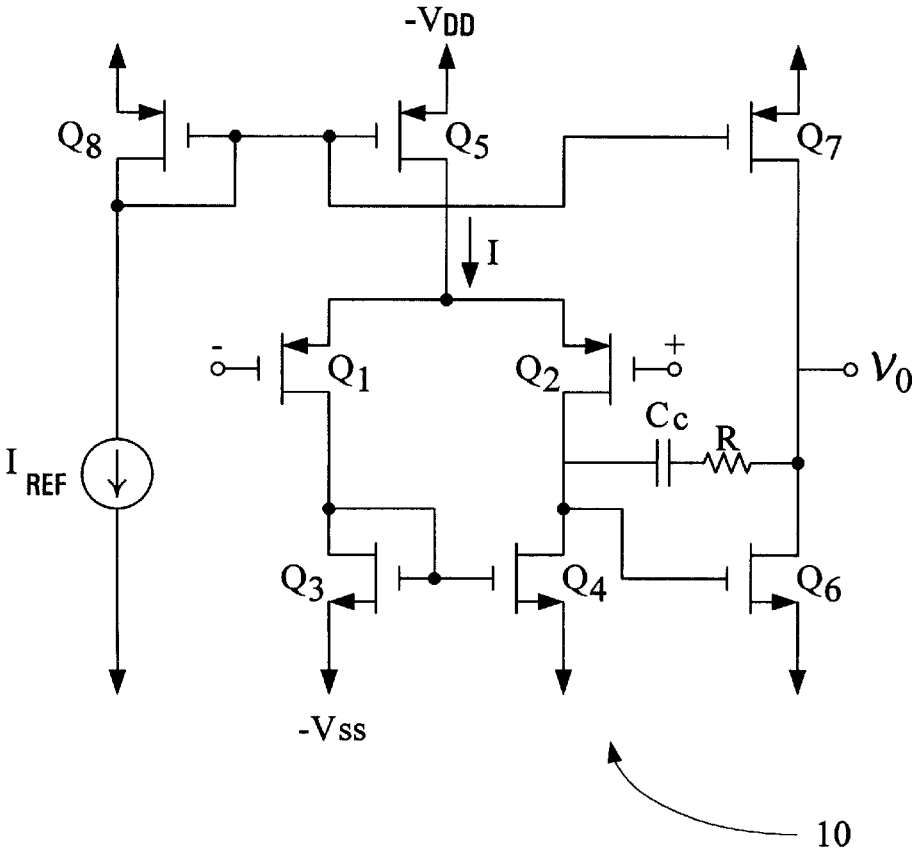
FIGURE 1B (Prior Art)
FIG. 1B is a schematics diagram illustrating one implementation of the prior art operational amplifier of FIG. 1A.
Figure 2:
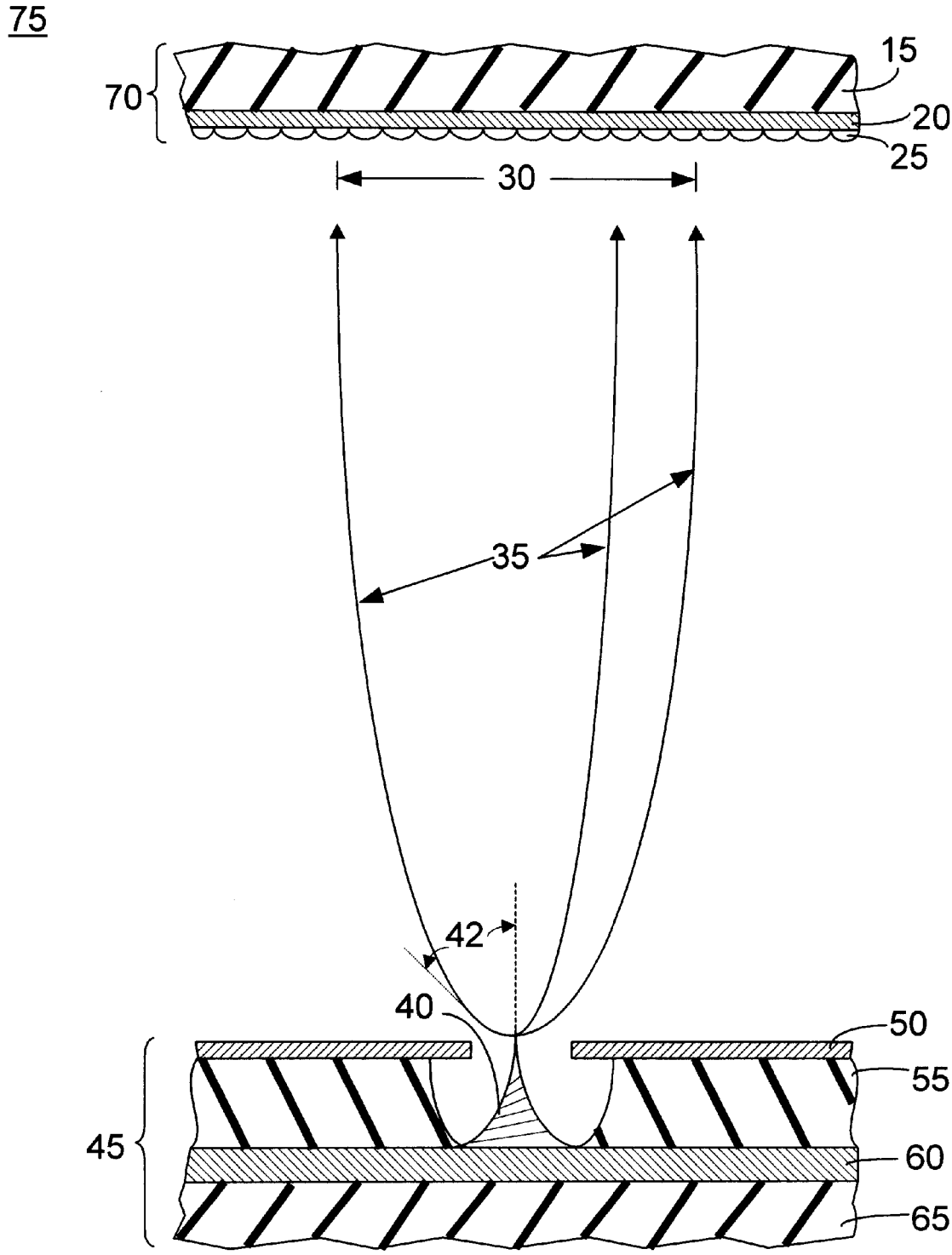
FIG. 2 is a cross section structural view of part of a flat panel FED screen that utilizes a gated field emitter situated at the intersection of a row and a column line.

A discussion of an emitter of a field emission display is presented. FIG. 2 illustrates a multi-layer structure 75 which is a portion of an FED flat panel display. The multi-layer structure 75 contains a field-emission backplate structure 45, also called a baseplate structure, and an electron-receiving faceplate structure 70. An image is generated by faceplate structure 70. Backplate structure 45 commonly consists of an electrically insulating backplate 65, an emitter (or cathode) electrode 60, an electrically insulating layer 55, a patterned gate electrode 50, and an electron-emissive element 40 situated in an aperture through insulating layer 55. One type of electron-emissive element 40 is described in U.S. Pat. No. 5,608,283, issued on Mar. 4, 1997 to Twichell et al. and another type is described in U.S. Pat. No. 5,607,335, issued on Mar. 4, 1997 to Spindt et al., which are both incorporated herein by reference. The tip of the electron-emissive element 40 is exposed through a corresponding opening in gate electrode 50. Emitter electrode 60 and electron-emissive element 40 together constitute a cathode of the illustrated portion 75 of the FED flat panel display. Faceplate structure 70 is formed with an electrically insulating faceplate 15, an anode 20, and a coating of phosphors (or phosphor deposits) 25. Electrons emitted from element 40 are received by phosphors portion 30. Element 40 may comprise a conical molybdenum tip.

Anode 20 of FIG. 2 is maintained at a positive voltage relative to cathode 60/40. The anode voltage is 100–300 volts for spacing of 100–200 um between structures 45 and 70 but in other embodiments with greater spacing the anode voltage is in the kilovolt range. Because anode 20 is in contact with phosphors 25, the anode voltage is also impressed on phosphors 25. When a suitable gate voltage is applied to gate electrode 50, electrons are emitted from electron-emissive element 40 at various values of off-normal emission angle theta 42. The emitted electrons follow non-linear (e.g., parabolic) trajectories indicated by lines 35 in FIG. 2 and impact on a target portion 30 of the phosphors 25. The phosphors struck by the emitted electrons produce light of a selected color and represent a phosphor spot. A single phosphor spot can be illuminated by thousands of emitters.

Figure 3:
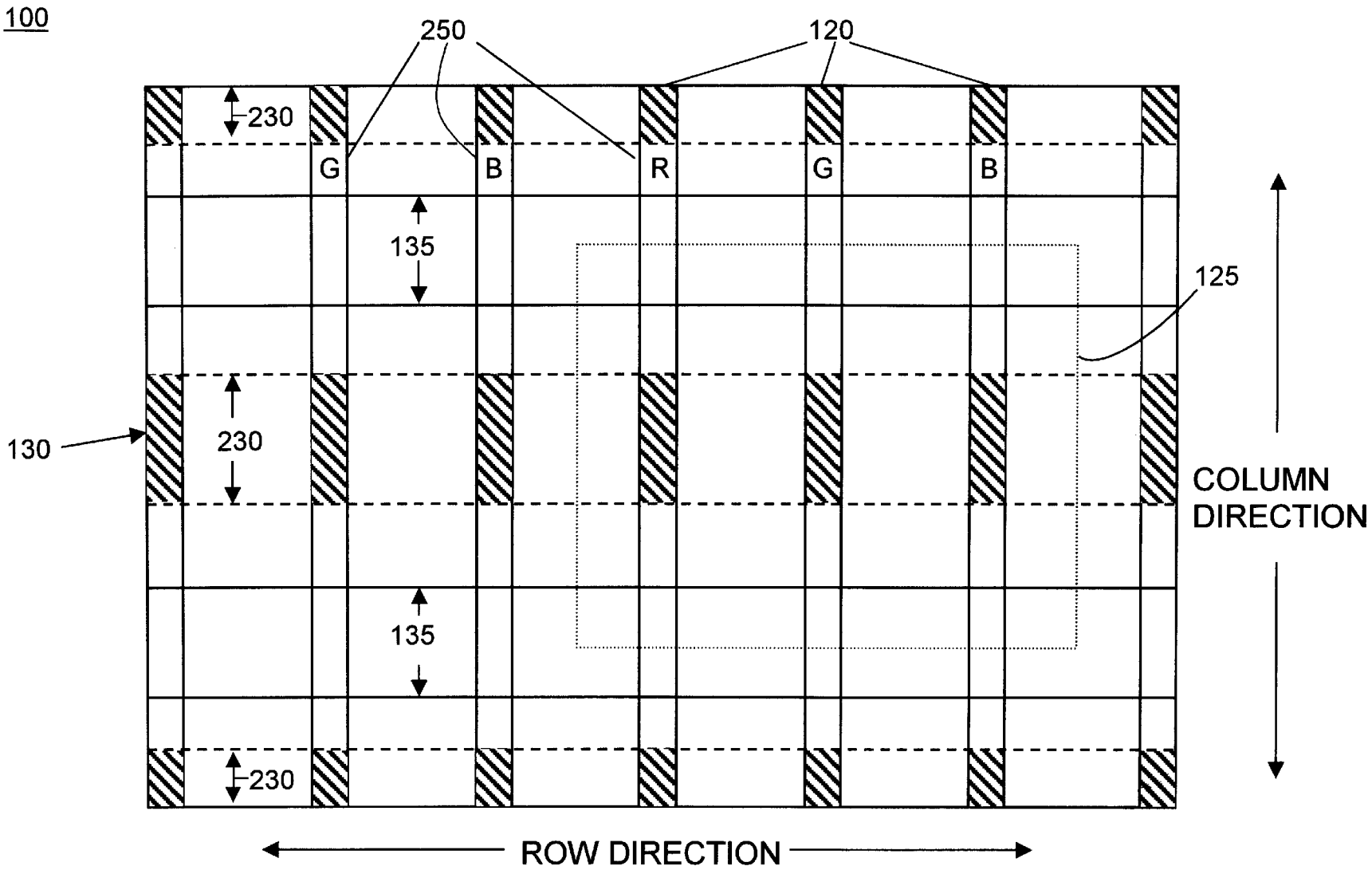
FIG. 3 is a plan view of internal portions of the flat panel FED screen of the present invention and illustrates several intersecting rows and columns of the display.

As shown in FIG. 3, the FED flat panel display 100 is subdivided into an array of horizontally aligned rows and vertically aligned columns of pixels. A portion 100 of this array is shown in FIG. 3. The boundaries of a respective pixel 125 are indicated by dashed lines. Three separate row lines 230 are shown. Each row line 230 is a row electrode for one of the rows of pixels in the array. In one embodiment, each row line 230 is coupled to the emitter cathodes 60/40 (FIG. 2) of each emitter of the particular row associated with the electrode. A portion of one pixel row is indicated in FIG. 3 and is situated between a pair of adjacent spacer walls 135. A pixel row is comprised of all of the pixels along one row line 230. Two or more pixels rows (and as much as 24–100 pixel rows), are generally located between each pair of adjacent spacer walls 135. Each column of pixels has three column lines 250: (1) one for red; (2) a second for green; and (3) a third for blue. Likewise, each pixel column includes one of each phosphor stripes (red, green, blue), three stripes total. In the present embodiment, each of the column lines 250 is coupled to the gate 50 (FIG. 2) of each emitter structure of the associated column. This structure 100 is described in more detail in U.S. Pat. No. 5,477,105 issued on Dec. 19, 1995 to Curtin, et al., which is incorporated herein by reference. It should be appreciated that, in other FED designs, the column lines may be coupled to the emitter cathodes and the row lines may be coupled to the gate electrodes, and that the present invention is applicable to those FED designs as well.

The red, green and blue phosphor stripes 25 (FIG. 2) are maintained at a positive voltage relative to the voltage of the emitter-cathode 60/40. When one of the sets of electron-emission elements 40 is suitably excited by adjusting the voltage of the corresponding row lines 230 (FIG. 3) and column lines 250 (FIG. 3), elements 40 in that set emit electrons which are accelerated toward a target portion 30 of the phosphors in the corresponding color. The excited phosphors then emit light. During a screen frame refresh cycle (performed at a rate of approximately 60 Hz in one embodiment), only one row is active at a time and the column lines are energized to illuminate the one row of pixels for the on-time period. This is performed sequentially in time, row by row, until all pixel rows have been illuminated to display the frame. Frames are presented at 60 Hz. Assuming n rows of the display array, each row is energized at a rate of 16.7/n ms. The above FED configuration is described in more detail in the following United States Patents: U.S. Pat. No. 5,541,473 issued on Jul. 30, 1996 to Duboc, Jr. et al.; U.S. Pat. No. 5,559,389 issued on Sep. 24, 1996 to Spindt et al.; U.S. Pat. No. 5,564,959 issued on Oct. 15, 1996 to Spindt et al.; and U.S. Pat. No. 5,578,899 issued Nov. 26, 1996 to Haven et al., which are incorporated herein by reference.

Figure 4:
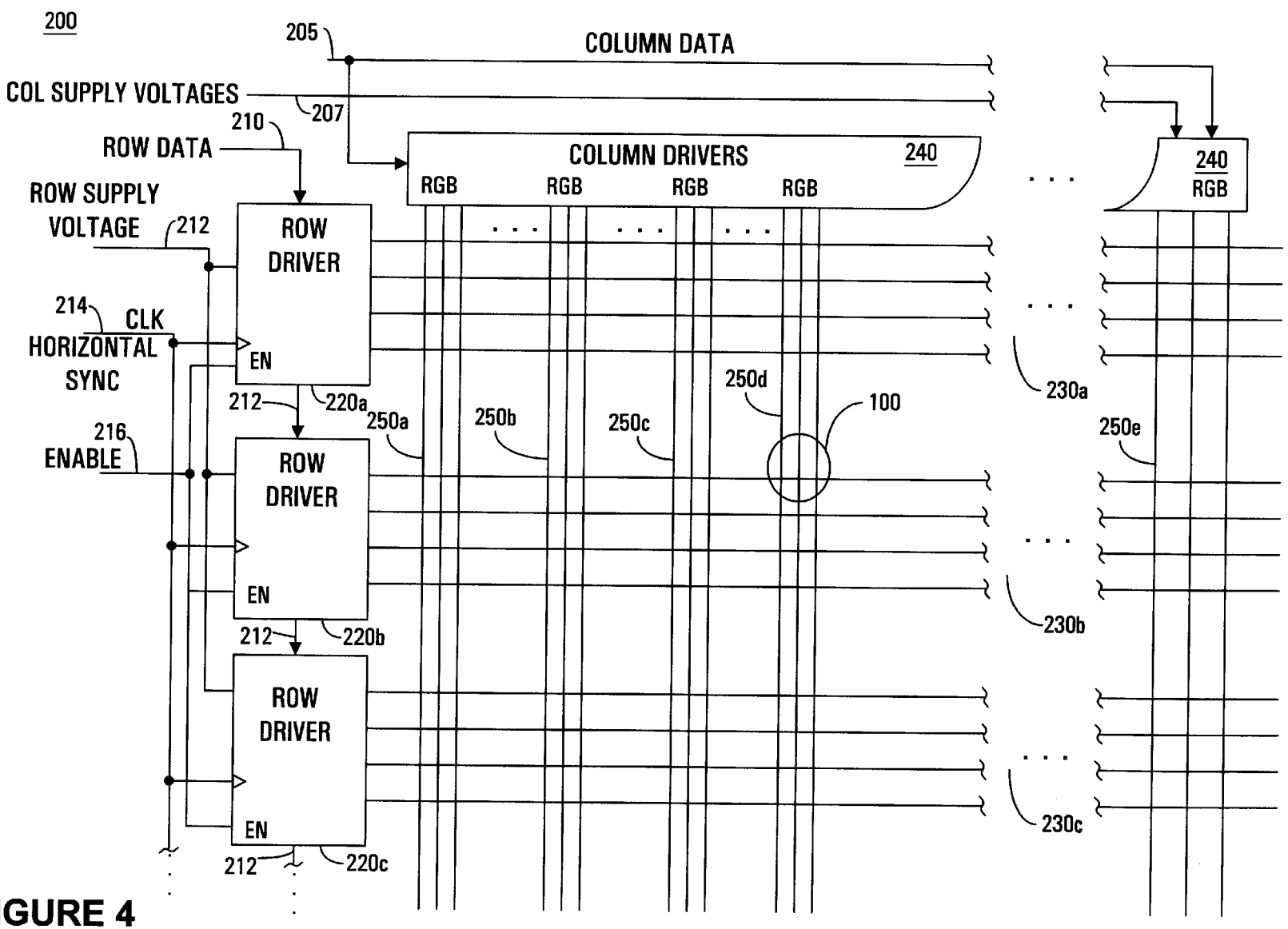
FIG. 4 illustrates a plan view of a flat panel FED screen in accordance with the present invention illustrating row and column drivers and numerous intersecting rows and columns.

FIG. 4 illustrates an FED flat panel display 200 in accordance with the present invention. Region 100, as described with respect to FIG. 3, is also shown in FIG. 4. The FED flat panel display 200 consists of n row lines (horizontal) and x column lines (vertical). For clarity, a row line is called a "row" and a column line is called a "column." Row lines are driven by row driver circuits 220*a*–220*c*. Shown in FIG. 4 are row groups 230*a*, 230*b* and 230*c*. Each row group is associated with a particular row driver circuit; three row driver circuits are shown 220*a*–220*c*. In one embodiment of the present invention there are over 400 rows and approximately 5–10 row driver circuits. However, it is appreciated that the present invention is equally well suited to an FED flat panel display screen having any number of rows. Also shown in FIG. 4 are column groups 250*a*, 250*b*, 250*c* and 250*d*. In one embodiment of the present invention there are over 1920 columns. However, it is appreciated that the present invention is equally well suited to an FED flat panel display screen having any number of columns. A pixel requires three columns (red, green, blue), therefore, 1920 columns provides at least 640 pixel resolution horizontally.

In the embodiment illustrated in FIG. 4, an enable signal is also supplied to each row driver 220*a*–220*c* in parallel over enable line 216. In the present embodiment, when the enable line 216 is low, all row drivers 220*a*–220*c* of FED screen 200 are disabled and no row is energized. When the enable line 216 is high, the row drivers 220*a*–220*c* are enabled.

In the particular embodiment of FIG. 4, a horizontal clock signal is also supplied to each row driver 220*a*–220*c* in parallel over clock line 214. The horizontal clock signal or synchronization signal pulses upon each time a new row is to be energized. The n rows of a frame are energized, one at a time, to form a frame of data. Assuming an exemplary frame update rate of 60 Hz, all rows are updated once every 16.67 milliseconds. Assuming n rows per frame update, the horizontal clock signal pulses once every 16.67/n milliseconds. In other words a new row is energized every 16.67/n milliseconds. If n is 400, the horizontal clock signal pulses once every 41.67 microseconds.

As shown by FIG. 4, there are three columns per pixel within the FED flat panel display 200 of the present invention. Column lines 250*a* control one column of pixels, column lines 250*c* control another column line of pixels, etc. FIG. 4 also illustrates the column drivers 240 that control the gray-scale information for each pixel. The column drivers 240 drive amplitude modulated voltage signals over the column lines. The amplitude modulated voltage signals driven over the column lines 250*a*–250*e* represent gray-scale data for a respective row of pixels. Once every pulse of the horizontal clock signal at line 214, the column drivers 240 receive gray-scale data to independently control all of the column lines 220*a*–220*e* of a pixel row of the FED flat panel display screen 200. Therefore, while only one row is energized per horizontal clock, all columns 220*a*–220*e* are energized during the on-time window. The horizontal clock signal over line 214 synchronizes the loading of a pixel row of gray-scale data into the column drivers 240. Column drivers 240 receive column data over column data line 205 and column drivers 240 are also coupled in common to a column voltage supply line 207. In one embodiment, column drivers 240 are implemented on a same integrated circuit. However, it should be appreciated that column drivers 240 can be implemented on separate integrated-circuits that each drives groups of column lines.

Different voltages are applied to the column lines by the column drivers 240 to realize different gray-scale colors. In operation, all column lines are driven with gray-scale data (over column data line 205) and simultaneously one row is activated. This causes a row of pixels of illuminate with the proper gray-scale data. This is then repeated for another row, etc., once per pulse of the horizontal clock signal of line 214, until the entire frame is filled. To increase speed, while one row is being energized, the gray-scale data for the next pixel row is simultaneously loaded into the column drivers 240. Like the row drivers, 220*a*–220*c* the column drivers assert their voltages within the on-time window. Further, like the row drivers 220*a*–220*c*, the column drivers 240 have an enable line. In accordance with the present invention, the column drivers 240 each includes a column driver amplifier for providing necessary current to energize a respective column of the FED 200.

COLUMN DRIVER AMPLIFIER ACCORDING TO THE PRESENT INVENTION

Figure 5:
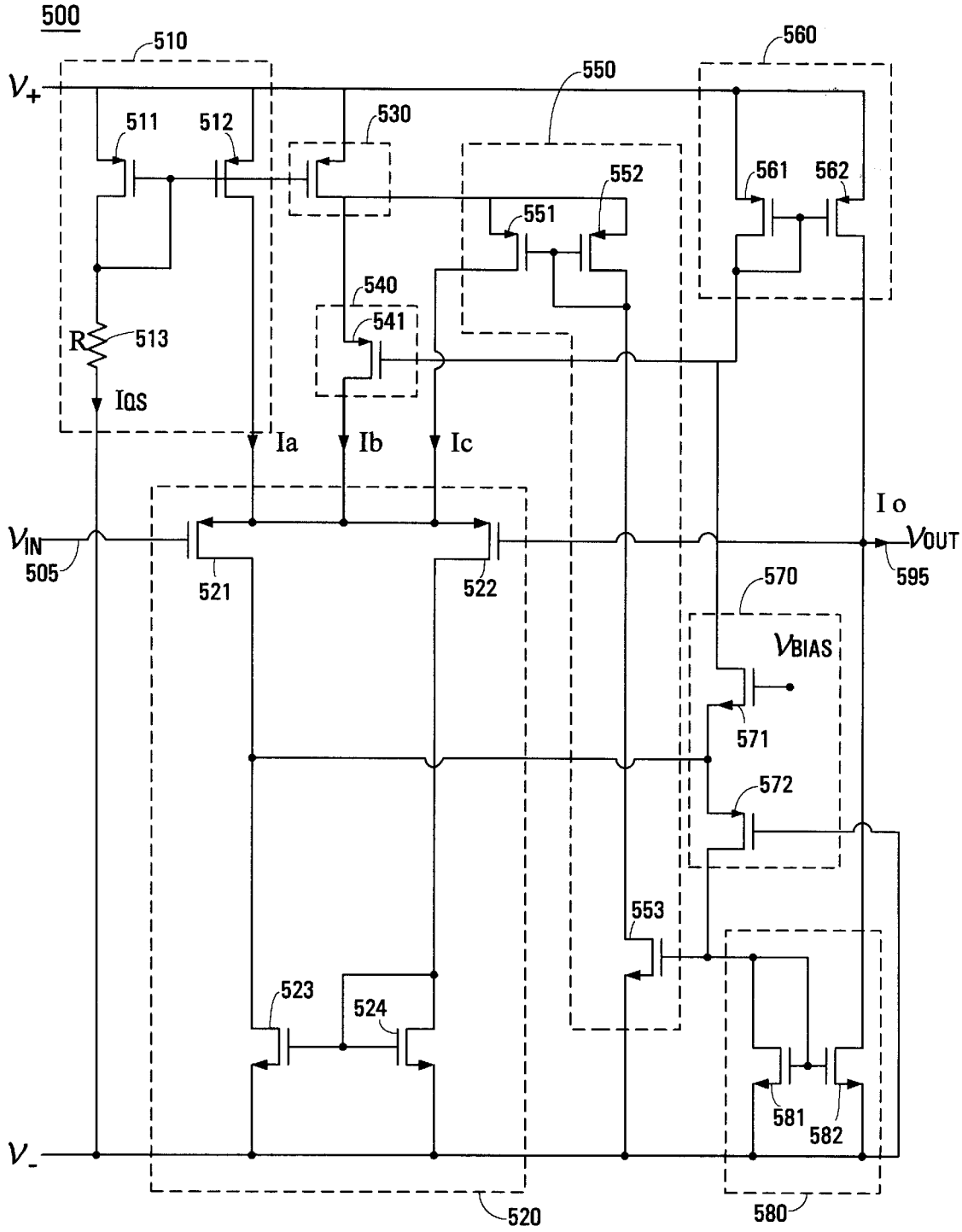
FIG. 5 illustrates a schematic diagram of a column driver amplifier circuit according to one embodiment of the present invention.

FIG. 5 is a schematic diagram illustrating an amplifier circuit 500 that can be used within the column driver 240 (FIG. 4) according to one embodiment of the present invention. In accordance with one embodiment of the present invention, amplifier circuit 500 is configured for receiving an input voltage signal $V_{IN}$ from D/A converters (not shown) that convert column data from column data line 205, and for providing an output voltage signal $V_{OUT}$ to one of column lines 250*a*–*d*. As illustrated, amplifier circuit 500 includes an input 505, an output 595, and a voltage sensing circuit 520 for monitoring a voltage differential between input 505 and output 595. In the present embodiment, input 505 is configured for coupling to D/A converters (not shown) to receive input voltage signal $V_{IN}$, and output 595 is configured for coupling to one of column lines 250*a–d* to provide output voltage signal $V_{OUT}$.

In the present embodiment, voltage sensing circuit 520 is coupled to a quiescent current source 510 to receive a quiescent current $I_a$ In addition, voltage sensing circuit 520 is coupled to current-boosting circuits 540 and 550 to receive additional bias currents $I_b$ and $I_c$ when a voltage differential exists between input 505 and output 595. Significantly, current-boosting circuits 540 and 550 are inactive during quiescent conditions. Therefore, quiescent current and quiescent power dissipation are kept at a low level.

In the particular embodiment as illustrated in FIG. 5, amplifier circuit 500 further comprises a current-steering circuit 570 coupled to voltage sensing circuit 520. The current-steering circuit 570 is further coupled to a first output current source 560, a first current-boosting circuit 540, a second output current source 580, and a second current-boosting circuit 550. Output current sources 560 and 580 are coupled to output 595 for providing output current. In addition, in the present embodiment, amplifier circuit 500 further comprises a bias current limiter 530 for limiting the amount of additional bias current available to current-boosting circuits 540 and 550.

Specifically, in one embodiment, quiescent current source 510 is a current mirror circuit having a P-type MOS transistor (PMOS) 511 and a PMOS 512. The sources of PMOS 511 and 512 are coupled to a positive supply voltage $V_+$, and the gates of PMOS 511 and 512 are coupled to a drain of PMOS 511, and to a first end of resistor 513. A second end of resistor 513 is coupled to a negative voltage $V_-$. In operation, a quiescent-setting current $I_{QS}$ flows from the drain of PMOS 511 across resistor 513. In response to the quiescent-setting current $I_{QS}$, PMOS 512 drives a quiescent current, $I_a$, into voltage sensing circuit 520.

According to the present embodiment, voltage sensing circuit 520 of FIG. 5 is a differential amplifier including PMOS 521 and 522, N-type MOS transistor (NMOS) 523 and NMOS 524. The gate of PMOS 521 is coupled to input 505 to receive input voltage signal $V_{IN}$, and the gate of PMOS 522 is coupled to output 595 to detect output voltage signal $V_{OUT}$. The sources of PMOS 521 and 522 are coupled together and to the drain of PMOS 512 to receive quiescent current $I_a$. The drain of PMOS 521 is coupled to a drain of NMOS 523. The drain of PMOS 522 is coupled to the drain of NMOS 524, and is also coupled to the gates of NMOS 523 and 524. The sources of NMOS 523 and 524 are coupled to the negative supply voltage (e.g. $V_{SS}$). Significantly, the drains of PMOS 521 and NMOS 523 are coupled to current-steering circuit 570.

In the present embodiment, current-steering circuit 570 of FIG. 5 comprises NMOS 571 and PMOS 572. The gate of NMOS 571 is coupled to receive a bias voltage $V_{BIAS}$, and the gate of PMOS 572 is coupled to the negative supply voltage $V_-$. The drain of NMOS 571 is coupled to first current-boosting circuit 540 and to first output current source 560. The source of PMOS 572 is coupled to second current-boosting circuit 550 and second current source 580. Significantly, depending on the a voltage differential between input 505 and output 595 (e.g. $V_{IN}$–$V_{OUT}$), voltage sensing circuit 520 causes current-steering circuit 570 to selectively activate a respective one of the first and second current-boosting circuits 540 and 550 to provide additional bias current. Contemporaneously, depending on the voltage differential, current-steering circuit 570 selectively activates a respective one of first and second output current sources 560 and 580 to drive output 595. For example, if the voltage differential between input 505 and output 595 is positive, first output current source 560 and first current-boosting circuit 540 are activated. On the other hand, if the voltage differential is negative, second output current source 560 and second current-boosting circuit 550 are activated. $V_{BIAS}$ is used for setting up a minuscule amount of continuous current flow from first current source 560 and second current source 580 to avoid "dead time." Dead time and the mechanics of eliminating dead time are well known in the art, and are not discussed herein to avoid obscuring aspects of the present invention.

In accordance with the specific embodiment as illustrated in FIG. 5, first current-boosting circuit 540 comprises a PMOS 541 having a source coupled to bias current limiter 530, a gate coupled to the drain of NMOS 571 of current-steering circuit 570, and a drain coupled to the sources of PMOS 521 and 522. In the present embodiment, second current-boosting circuit 540 comprises an NMOS 553, and PMOS 551 and 552. A source of the NMOS 553 is coupled to the negative supply voltage $V_-$, and a gate of NMOS 553 is coupled to a current-steering circuit 570 and second output current source 580. PMOS 551 and 552 are coupled together in a current mirror configuration with their common sources coupled to bias current limiter 530 and their common gates coupled to the drain of PMOS 552. The drain of PMOS 552 is also coupled to the drain of NMOS 553. The drain of PMOS 551 is coupled to the common sources of PMOS 521 and 522 of voltage sensing circuit 520.

Additionally, in the particular embodiment as illustrated in FIG. 5, first output current source 560 comprises PMOS 561 and 562 configured in a current mirror configuration with their common sources coupled to receive the positive supply voltage $V_+$, and their common gates coupled to the drain of the PMOS 561 and to current-steering circuit 570 and first current-boosting circuit 540. Second output current 580 of the present embodiment comprises NMOS 581 and 582 configured in a current mirror configuration with their common sources coupled to receive the negative supply voltage $V_-$, and with their common gates coupled to the drain of NMOS 581 and to the current-steering circuit 570 and second current-boosting circuit 550.

In operation, suppose the input voltage signal $V_{IN}$ is stepped up from 0V to 15 V from quiescent conditions. In this case, the gate of PMOS 521 is positive while the output 595 is still at 0V. Thus, PMOS 521 stops pulling any current. As a result, NMOS 523 is pulling down. Not only is it pulling down, NMOS 523 is pulling down twice as hard as it would have pulled down under quiescent conditions. Consequently, the drain of NMOS 523 goes negative, pulling down on the source of NMOS 571. Then, the drain of NMOS 571 pulls down on the gates of PMOS 561 and 562 of first output current source 560. In the present embodiment, PMOS 561 and 562 are configured as a current mirror. Thus, an output current, $I_O$, is provided by first output current source 560 to pull the output 595 up so that the output voltage signal $V_O$ equals the input voltage signal $V_{IN}$.

Significantly, the drain of NMOS 571 of FIG. 5 is also coupled to the gate of PMOS 541 of first current-boosting circuit 540. Therefore, when the drain of NMOS 571 is pulled down, an additional bias current, $I_b$, would flow into the sources of PMOS 521 and 522. In this way, when the PMOS 562 is pulling up output 595, first current-boosting circuit 540 is also pulling up on the common sources of PMOS 521 and 522 so that the bias current increases. As additional bias current is available, the slew rate of the amplifier is increased.

Similarly, suppose the input voltage signal $V_{IN}$ is stepped down from 15V to 0 v V from quiescent conditions. In this case, the gate of PMOS 521 is at 0V while the output 595 is still positive. Thus, PMOS 521 is pulling up. Consequently, the source of PMOS 572 must go positive. Then, the drain of NMOS 572 pulls up on the gates of NMOS 581 and 582 of second output current source 580. As illustrated, NMOS 581 and 582 are configured as a current mirror. Thus, an output current, $I_O$, is provided by second output current source 580 to pull the output 595 down so that the output voltage signal $V_O$ equals the input voltage signal $V_{IN}$.

Significantly, the drain of PMOS 572 is also coupled to the gate of NMOS 553 of second current-boosting circuit 540. Pulling up the gate of NMOS 553 will cause the common gate of PMOS 551 and 552 to be pulled down. Additionally, pulling down the gate of NMOS 553 will cause a current to flow from the drain of PMOS 552 to the drain of NMOS 553. PMOS 551 and 552 are configured as a current mirror. Therefore, an additional bias current, $I_C$, would flow into the sources of PMOS 521 and 522. In this way, when the NMOS 582 is pulling down the output 595, second current-boosting circuit 550 is also pulling up on the common sources of the differential pair 521 and 522 so that the bias current increases. As additional bias current is available, the slew rate of the amplifier is also increased.

One significant feature of the present embodiment is that the maximum amount of additional bias current available to PMOS 521 and 522 is limited by bias current limiter 530. In the present embodiment, bias current limiter 530 comprises a PMOS transistor 531. The gate of PMOS 531 is coupled to the gates of PMOS 511 and 512 of quiescent current source 510, and the source of PMOS 531 is coupled to the positive voltage supply $V_+$. The drain of PMOS 531 is coupled to first current-boosting circuit 540 and second current-boosting circuit 550. As is well known, the maximum amount of additional bias current available to the current-boosting circuits 540 and 550 is dependent upon the aspect ratios (W/L) of PMOS 531 and 512.

Figure 6:
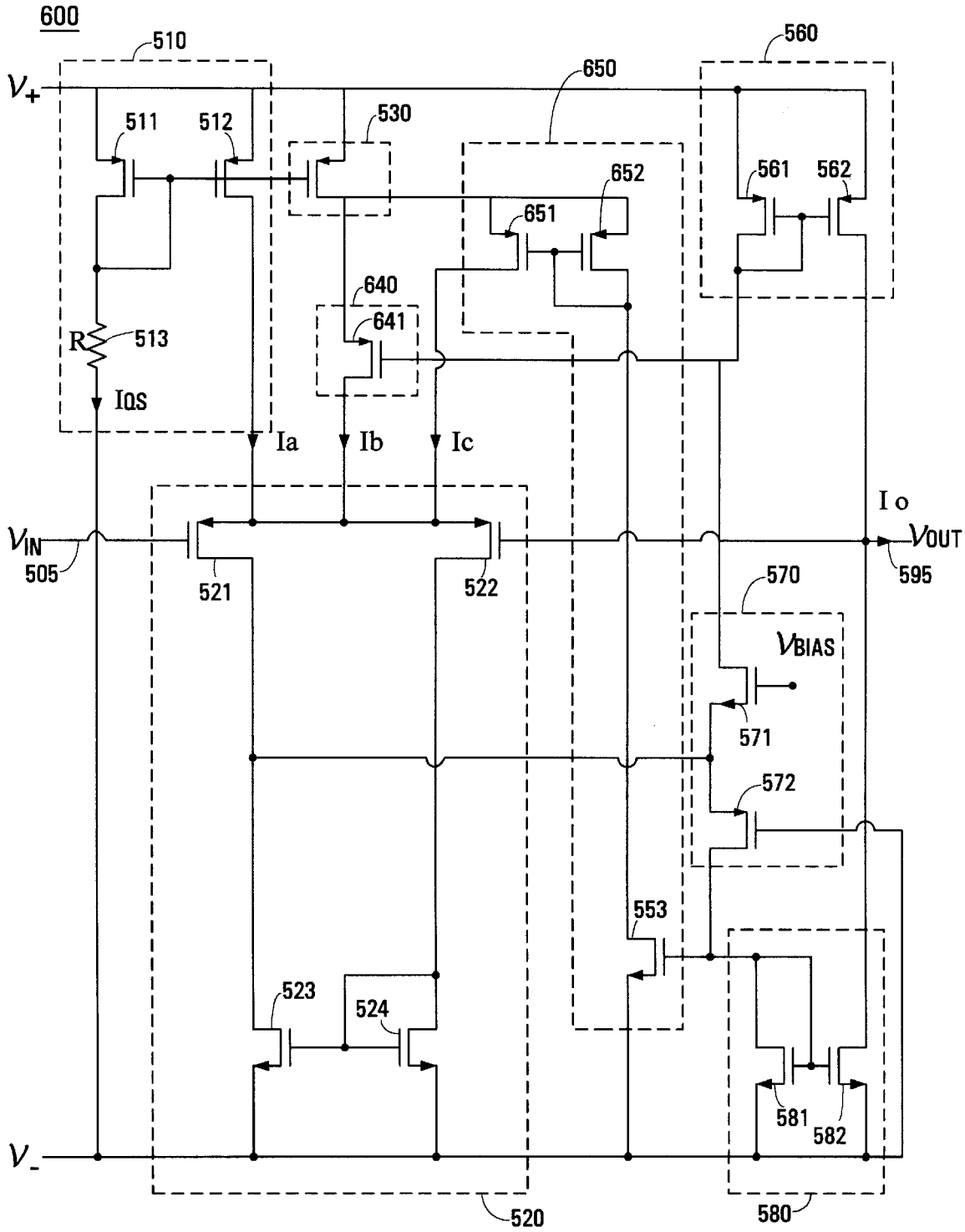
FIG. 6 illustrates a schematic diagram of a column driver amplifier circuit according to another embodiment of the present invention.

FIG. 6 illustrates a column driver amplifier circuit 600 according to an alternate embodiment of the present invention. In the present embodiment, column driver amplifier 600 comprises input 505, output 595, voltage sensing circuit 520, a current-steering circuit 570, first output current source 560, second output current source 580, and current-boosting circuits 640 and 650. The column driver amplifier 600 according to the present invention is nearly identical to the embodiment illustrated in FIG. 5. One significant difference is that, in the present embodiment, the amount of additional bias current available is not limited.

Specifically, in the present embodiment, the source of PMOS 641 of first current-boosting circuit 640 is coupled to the positive supply voltage $V_+$. Furthermore, the common source of PMOS 651 and 652 of second current-boosting circuit 650 is also coupled to the positive supply voltage $V_+$. Bias current-limiter 530 of FIG. 5 is not present in column amplifier circuit 600. Consequently, the maximum amount of additional bias current available for current boosting circuits 640 and 650 is significantly increased, and an even higher slew rate can be achieved in the present embodiment.

The present invention, a column driver amplifier for FEDs, has thus been disclosed. It should be appreciated that, while the present invention has been described in particular embodiments, the present invention should not be construed as limited by such embodiments, but rather construed according to the below claims.

What is claimed is:

1. An amplifier circuit for driving signals within a field emission display, said amplifier circuit comprising:

an input for receiving an input voltage signal;

an output for providing an output voltage signal;

a voltage sensing circuit for monitoring a voltage differential between said input voltage signal and said output voltage signal;

a quiescent current source coupled to said voltage sensing circuit to provide a bias current during a quiescent condition; and a current-boosting circuit responsive to said voltage differential and coupled to said voltage sensing circuit for providing additional bias current when said input voltage signal changes for increasing a slew rate of said output voltage signal.

2. The amplifier circuit according to claim 1 wherein said quiescent condition occurs when said input voltage signal is constant and wherein said output voltage signal is substantially equivalent to said input voltage signal.

3. The amplifier circuit according to claim 1 wherein said current-boosting circuit is inactive during said quiescent condition.

4. The amplifier circuit according to claim 1 wherein said current-boosting circuit further comprises:

a first sub-circuit for providing additional bias current to said voltage sensing circuit when said input voltage signal is higher than said output voltage signal; and a second sub-circuit for providing additional bias current to said voltage sensing circuit when said input voltage signal is lower than said output voltage signal.

5. The amplifier circuit according to claim 1 further comprising a bias current limiter coupled to said current-boosting circuit for limiting an amount of additional bias current available to said voltage sensing circuit.

6. The amplifier circuit according to claim 1 further comprising:

a first output current source for providing a first output current to said output when said input voltage signal is higher than said output voltage signal; and a second output current source for providing a second output current to said output when said input voltage signal is lower than said output voltage signal.

7. The amplifier circuit according to claim 1 wherein said field emission display comprises a plurality of row lines, a plurality of column lines, and a plurality of electron emissive elements coupled between said plurality of row lines and said plurality of column lines, and wherein said output coupled to one of said plurality of column lines for driving said one column line.

8. The amplifier circuit according to claim 7 wherein said plurality of electron emissive elements each comprises a molybdenum tip.

9. Within a field emission display having a plurality of row lines, a plurality of column lines, and a plurality of electron-emissive elements disposed at intersections of said plurality of row and column lines, electronic circuitry comprising:

a row driver coupled to said plurality of row lines, said row driver for driving row voltages over said plurality of row lines; and a plurality of column driver amplifiers for driving column voltages over said plurality of column lines, wherein said plurality of column driver amplifiers each further comprises:

an input for receiving an input voltage signal;

an output coupled to a respective one of said plurality of column lines, said output for driving an output voltage signal over said respective column line;

a voltage sensing circuit for monitoring a voltage differential between said input voltage signal and said output voltage signal;

a quiescent current source coupled to said voltage sensing circuit to provide a bias current during a quiescent condition; and a current-boosting circuit responsive to said voltage differential and coupled to said voltage sensing circuit for providing additional bias current when said input voltage signal changes for increasing a slew rate of said output voltage signal.

10. The electronic circuitry according to claim 9 wherein said quiescent condition occurs when said input voltage signal is constant and wherein said output voltage signal is substantially equivalent to said input voltage signal.

11. The electronic circuitry according to claim 9 wherein said current-boosting circuit is inactive during said quiescent condition.

12. The electronic circuitry according to claim 9 wherein said current-boosting circuit further comprises:

a first sub-circuit for providing additional bias current to said voltage sensing circuit when said input voltage signal is higher than said output voltage signal; and second sub-circuit for providing additional bias current to said voltage sensing circuit when said input voltage signal is lower than said output voltage signal.

13. The electronic circuitry according to claim 9 wherein said column driver amplifiers each further comprises a bias current limiter coupled to said current-boosting circuit for limiting an amount of additional bias current available to said voltage sensing circuit.

14. The electronic circuitry according to claim 9 wherein said column driver amplifiers each further comprises:

a first output current source for providing a first output current to said output when said input voltage signal is higher than said output voltage signal; and a second output current source for providing a second output current to said output when said input voltage signal is lower than said output voltage signal.

15. A field emission display comprising:

a plurality of row lines, a plurality of column lines, and a plurality of electron-emissive elements disposed at intersections of said plurality of row lines and column lines;

a row driver coupled to said plurality of row lines, said row driver for driving row voltages over said plurality of row lines; and a plurality of column driver amplifiers for driving column voltages over said plurality of column lines, wherein said plurality of column driver amplifiers each further comprises:

an input for receiving an input voltage signal;

an output for providing an output voltage signal;

a voltage sensing circuit for monitoring a voltage differential between said input voltage signal and said output voltage signal;

a quiescent current source coupled to said voltage sensing circuit to provide a bias current during a quiescent condition; and a current-boosting circuit responsive to said voltage differential and coupled to said voltage sensing circuit for providing additional bias current when said input voltage signal changes to increase a slew rate of said output voltage signal.

16. The field emission display according to claim 15 wherein said quiescent condition occurs when said input voltage signal is constant and wherein said output voltage signal is substantially equivalent to said input voltage signal.

17. The field emission display according to claim 15 wherein said current-boosting circuit is inactive during said quiescent condition.

18. The field emission display according to claim 15 wherein said current-boosting circuit further comprises:

a first sub-circuit for providing additional bias current to said voltage sensing circuit when said input voltage signal is higher than said output voltage signal; and a second sub-circuit for providing additional bias current to said voltage sensing circuit when said input voltage signal is lower than said output voltage signal.

19. The field emission display according to claim 15 wherein said column driver amplifier further comprises a bias current limiter coupled to said current-boosting circuit for limiting an amount of additional bias current available for said voltage sensing circuit.

20. The field emission display according to claim 15 wherein said column driver amplifier further comprises:

a first output current source for providing a first output current to said output when said input voltage signal is higher than said output voltage signal; and a second output current source for providing a second output current to said output when said input voltage signal is lower than said output voltage signal.

21. The field emission display according to claim 15 wherein said plurality of electron emissive elements each comprises a molybdenum tip.

* * * * *